US006193536B1

(12) United States Patent
Sanuki

(10) Patent No.: US 6,193,536 B1
(45) Date of Patent: Feb. 27, 2001

(54) LIQUID-TIGHT CONNECTOR

(75) Inventor: Hidenori Sanuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/456,909

(22) Filed: Dec. 7, 1999

(30) Foreign Application Priority Data

Feb. 18, 1999 (JP) ..... 11-040491

(51) Int. Cl.[7] ..... H01R 13/52
(52) U.S. Cl. ..... 439/271; 439/276; 439/587
(58) Field of Search ..... 439/271, 272, 439/273, 274, 275, 276, 279, 281, 283, 587, 588, 589, 936

(56) References Cited

U.S. PATENT DOCUMENTS 4,445,748 * 5/1984 Evans ..... 439/271
5,637,007 * 6/1997 Suzuki et al. ..... 439/276

* cited by examiner

*Primary Examiner*—Paula Bradley
*Assistant Examiner*—Tho D. Ta
(74) *Attorney, Agent, or Firm*—Sughrue, Mion, Zinn, Macpeak & Seas, PLLC

(57) ABSTRACT

In a liquid-tight connector 20 of the present invention, a fitting recess portion 25*b* for fitting on a mating male connector portion 13 is formed in a female connector portion 25 of a housing 23, and a filling material 15 is filled in a filling material-pouring recess 25*d* which is formed in an inner bottom wall 25*a* of the fitting recess portion 25*b* to receive proximal portions of metal terminals 9 projecting from the inner bottom wall 25*a*. Three steps 31, 32 and 33 are formed on a peripheral surface of the filling material-pouring recess 25*d* over the entire periphery thereof to form a stair-like portion spreading outwardly toward an open end of the pouring recess 25*d*.

9 Claims, 7 Drawing Sheets

LIQUID-TIGHT CONNECTOR

BACKGROUND OF THE INVENTION

1. Field of the Invention

This invention relates to a liquid-tight connector for connecting electrical wires together, and more particularly to a liquid-tight connector which is mounted in a through hole in a casing filled with a liquid, and connects electrical wires provided inside the casing and electrical wires provided outside the casing in a liquid-tight manner.

2. Prior Art

For example, in an automatic transmission of an automobile, electrical wires of a solenoid valve, various sensors and so on which are mounted inside a transmission casing so as to control the transmission device are connected to a control. unit provided outside the transmission casing, through a connector mounted in a through hole in the transmission casing.

However, the interior of the transmission casing is filled with oil for lubricating the transmission device. Therefore, the above connector must be designed to connect the electrical wires provided inside the transmission casing and electrical wires provided outside the transmission casing, in such a manner as to prevent the oil within the transmission casing from leaking to the exterior of this casing.

Therefore, there has heretofore been used a liquid-tight connector 1 as shown in FIGS. 5 and 6. This liquid-tight connector 1 comprises a housing 3 of a synthetic resin for mounting on a transmission casing (not shown). And a connector 5 of a synthetic resin has a male connector portion 13 for fitting in a female connector portion 7 of the housing 3.

The female connector portion 7 of the housing 3 includes an inner bottom wall 7*a* through which male metal terminals 9 extends, and a fitting peripheral wall 7*c* which extends from a peripheral edge portion of the inner bottom wall 7*a* in a direction of projecting of the metal terminals 9 and forms a fitting recess portion 7*b* into which the male connector portion 13 of the mating connector 5 can be fitted.

The connector 5 has female metal terminals 11 (for connection respectively to the metal terminals 9) received and held respectively in terminal receiving chambers formed in the male connector portion 13.

The other end portions (right end portions in FIG. 6) of the metal terminals 9, provided in the housing 3, extend through the inner bottom wall 7*a* of the female connector portion 7 into the interior of a transmission casing. And the other end portions are electrically connected respectively to connection terminals of electrical parts within the transmission casing.

The housing 3 is required to have a high sealing performance so that foreign matters will not intrude into the interior of the transmission casing and that working oil or the like within the transmission casing will not leak to the exterior.

Therefore, in the housing 3, usually, the metal terminals 9 are insert molded in the female connector portion 7 to be integrally connected thereto, and in that side (surface) of the fitting recess portion of the inner bottom wall 7*a*, a filling material-pouring recess 7*d* is formed around a base portions of metal terminals projecting from said inner bottom wall of said fitting recess portion. A suitable amount of a filling material 15, such as an epoxy resin, is poured into the filling material-pouring recess 7*d*, thereby perfectly sealing the metal terminal-passing portions of the female connector portion 7.

As shown in FIG. 8, the filling material 15 is poured into the filling material-pouring recess 7*d* in the housing 3 by the use of a nozzle 17 insertable into the fitting recess portion 7*b*. Generally, the fitting recess portion 7*b* in the housing 3 has a narrow open end, and therefore the nozzle 17 is inserted generally vertically into the fitting recess portion 7*b*, and then the filling material 15 is poured.

During the pouring of the filling material 15 by the nozzle 17, the filling amount is confirmed through the open end of the fitting recess portion 7*b* with the eyes, and when the liquid level of the poured filling material 15 reaches the vicinity of the upper edge of the filling material-pouring recess 7*d*, the pouring of the filling material is stopped.

However, in the above conventional housing 3, it is difficult to accurately confirm the displacement of the liquid level of the filling material 15 during the pouring of the filling material 15 by the nozzle 17, and there were possibilities that the filling amount was so small that the sufficient sealing performance could not be achieved and that the filling amount was so large that the filling material 15 overflowed into the fitting recess portion 7*b*.

In the case where the filling material-pouring recess 7*d* has a generally rectangular transverse cross-section as shown in FIG. 7, the filling material 15 poured into the filling material-pouring recess 7*d* vigorously flows along the vertical peripheral wall of the filling material-pouring recess 7*d*, and therefore the liquid level becomes slightly higher at corner portions X (where a surface tension of the filling material is higher than at the other portions) than at the other portions. Therefore, even if the amount of filling of the filling material 15 is proper, the liquid level projects an amount $\Delta t$ beyond a pouring-limit line Z into the fitting. recess portion 7*b* at the corner portions X, as shown in FIG. 9.

The filling material 15, thus overflowed into the fitting recess portion 7*b*, is deposited on an inner surface of the fitting recess portion 7*b*, such as a bottom surface 7*e* thereof to be opposed to the front end surface of the male connector portion 13, and when this filling material 15 is solidified, there is a possibility that the two connectors are not properly fitted together.

SUMMARY OF THE INVENTION

It is therefore an object of this invention to solve the above problems and more specifically to provide a satisfactory liquid-tight connector in which the displacement of a liquid level of a filling material during the pouring of this filling material can be easily confirmed with the eyes, and an undesirable rise of the liquid level in a filling material-pouring recess is prevented, thereby preventing the incomplete fitting connection between two connectors.

The above object of the present invention has been achieved by a liquid-tight connector comprising:

- a fitting recess portion for fitting on a mating male connector portion is formed in a female connector portion of a housing;
- a filling material is filled in a filling material-pouring recess which is formed around a base portions of metal terminals projecting from said inner bottom wall of said fitting recess portion; and
- a step portion, spreading outwardly toward an open end of said filling material-pouring recess, formed on a peripheral surface of said filling material-pouring recess.

In the above construction, when the filling material is poured into the filling material-pouring recess provided at the inner end of the fitting recess portion of the female connector portion, through the open end of the fitting recess portion, by a nozzle, the displacement of the liquid level of the filling material during this pouring operation clearly differs visually, depending on whether or not the liquid level rises beyond the step portion, and therefore this displacement can be easily confirmed with the eyes.

Therefore, the uppermost step is spaced downwardly a suitable distance from the boundary between the fitting recess portion and the filling material-pouring recess so that the amount of filling of the filling material can become proper when the liquid level reaches the uppermost step. With this arrangement, there can be avoided disadvantages that the filling amount is so small that the sufficient sealing performance can not be achieved and that the filling amount is so large that the filling material overflows into the fitting recess portion.

In the case where the filling material-pouring recess has a generally rectangular transverse cross-section, a surface tension of the poured filling material is higher at each corner portion of the filling material-pouring recess.than at the other portions thereof, and therefore the liquid level of the filling material rises beyond the steps at the corner portions earlier than at the other portions. However, at this time, the liquid surface of the filling material spreads, and the liquid level-raising force is consumed in enlarging the area of the liquid surface. As a result, the rise of the liquid level at the corner portions of the filling material-pouring recess can be suppressed.

Therefore, there can be prevented the incomplete fitting connection between the two connectors due to the solidification of the filling material overflowed into the fitting recess portion to be deposited on an inner surface (e.g. a bottom surface) of the fitting recess portion.

DERAILED DESCRIPTION OF PREFERRED EMBODIMENTS

One preferred embodiment of a liquid-tight connector of the present invention will now be described in detail with reference to the accompanying drawings.

Figure 1:
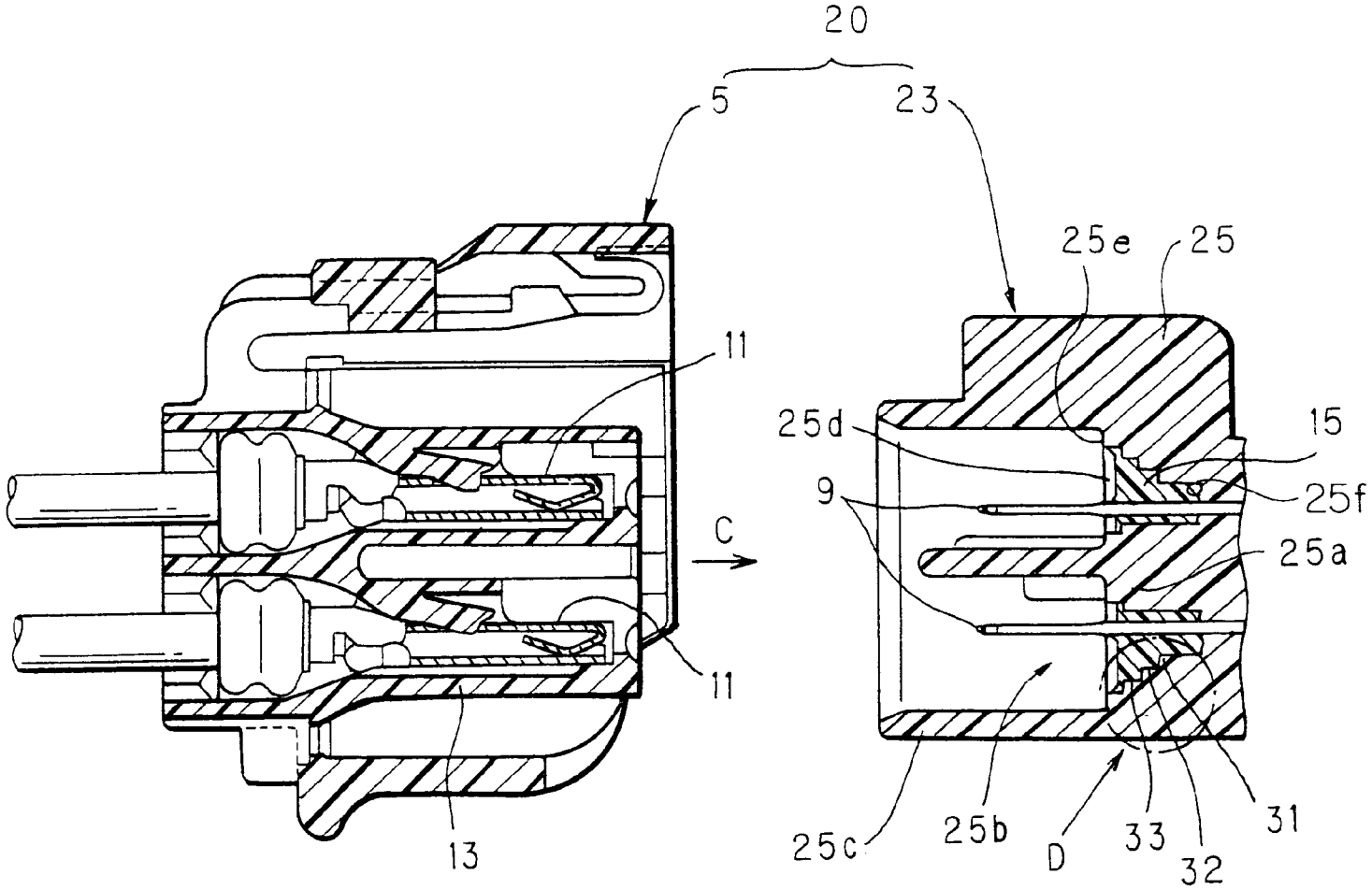
FIG. 1 is a vertical cross-sectional view of important portions of one preferred embodiment of a liquid-tight connector of the present invention.
Figure 2:
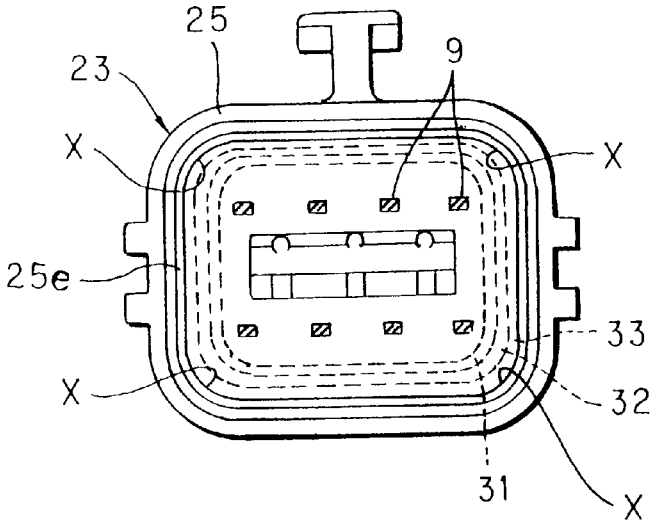
FIG. 2 is a view as seen in a direction of arrow C of FIG. 1.
Figure 3:
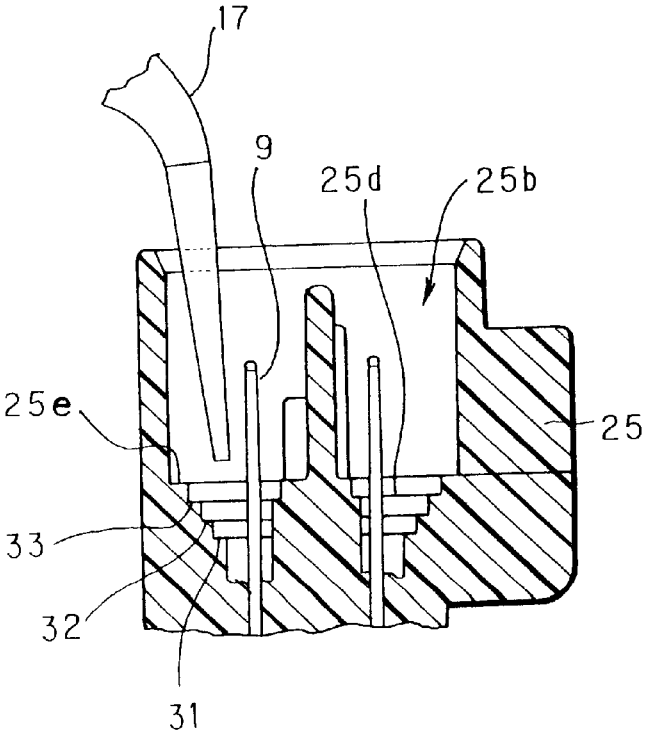
FIG. 3 is a vertical cross-sectional view of an important portion of the connector, showing a method of pouring a filling material into a housing of FIG. 1.
Figure 4A:
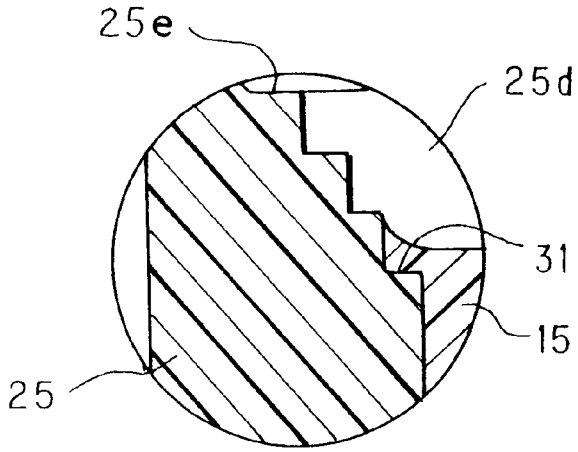
FIGS. 4(*a*) to 4(*c*) are enlarged views of a portion D of FIG. 1, showing a change of the liquid level, as well as a rise of the liquid level at each corner portion of a filling material-pouring recess, in accordance with the amount of filling of the filling material into the filling material-pouring.recess.
Figure 4B:
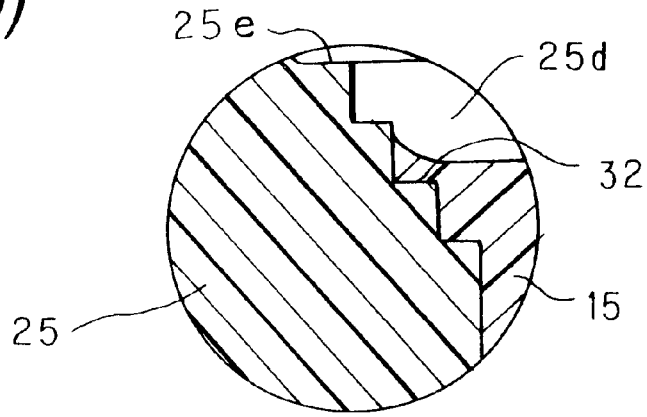
Figure 4C:
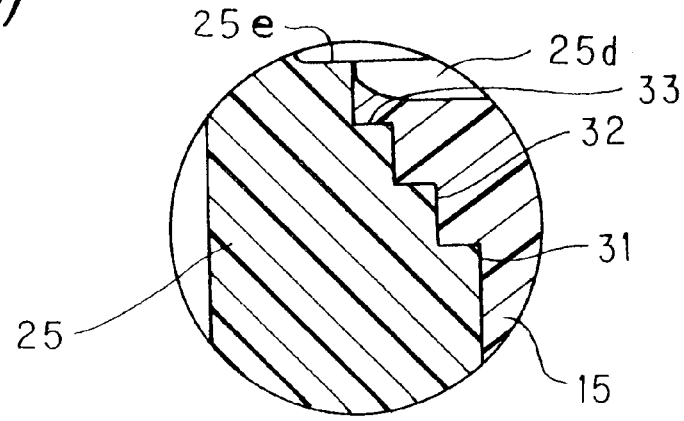

FIG. 1 is a vertical cross-sectional view of important portions of one preferred embodiment of the liquid-tight connector of the present invention. FIG. 2 is a view as seen in a direction of arrow C of FIG. 1. FIG. 3 is a vertical cross-sectional view of an important portion of the connector showing a method of pouring a filling material into a housing of FIG. 1. FIG. 4 is an enlarged view of a portion D of FIG. 1, showing a change of the liquid level, as well as a rise of the liquid level at each corner portion.of a filling material-pouring recess, and in accordance.with-the amount of filling of the filling material into the filling material-pouring recess.

Figure 5:
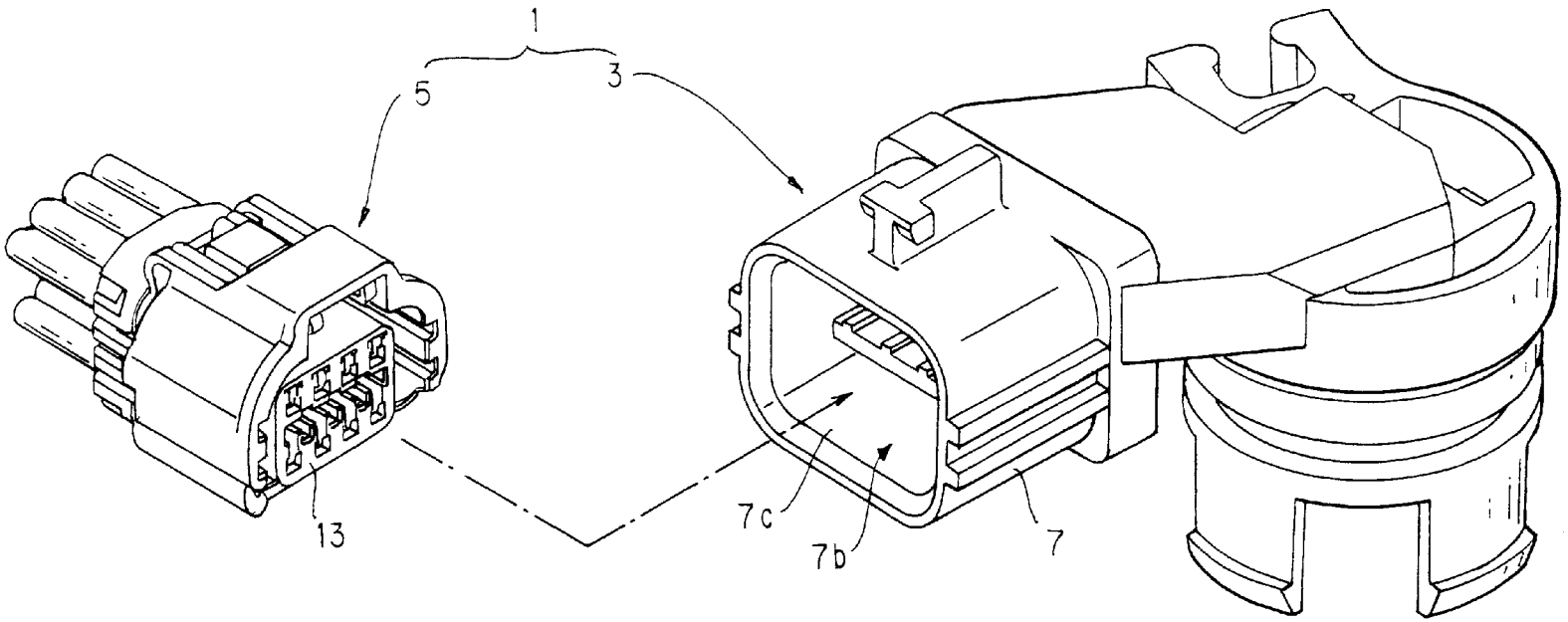
FIG. 5 PRIOR ART
FIG. 5 is an exploded, perspective view of a conventional liquid-tight connector.
Figure 6:
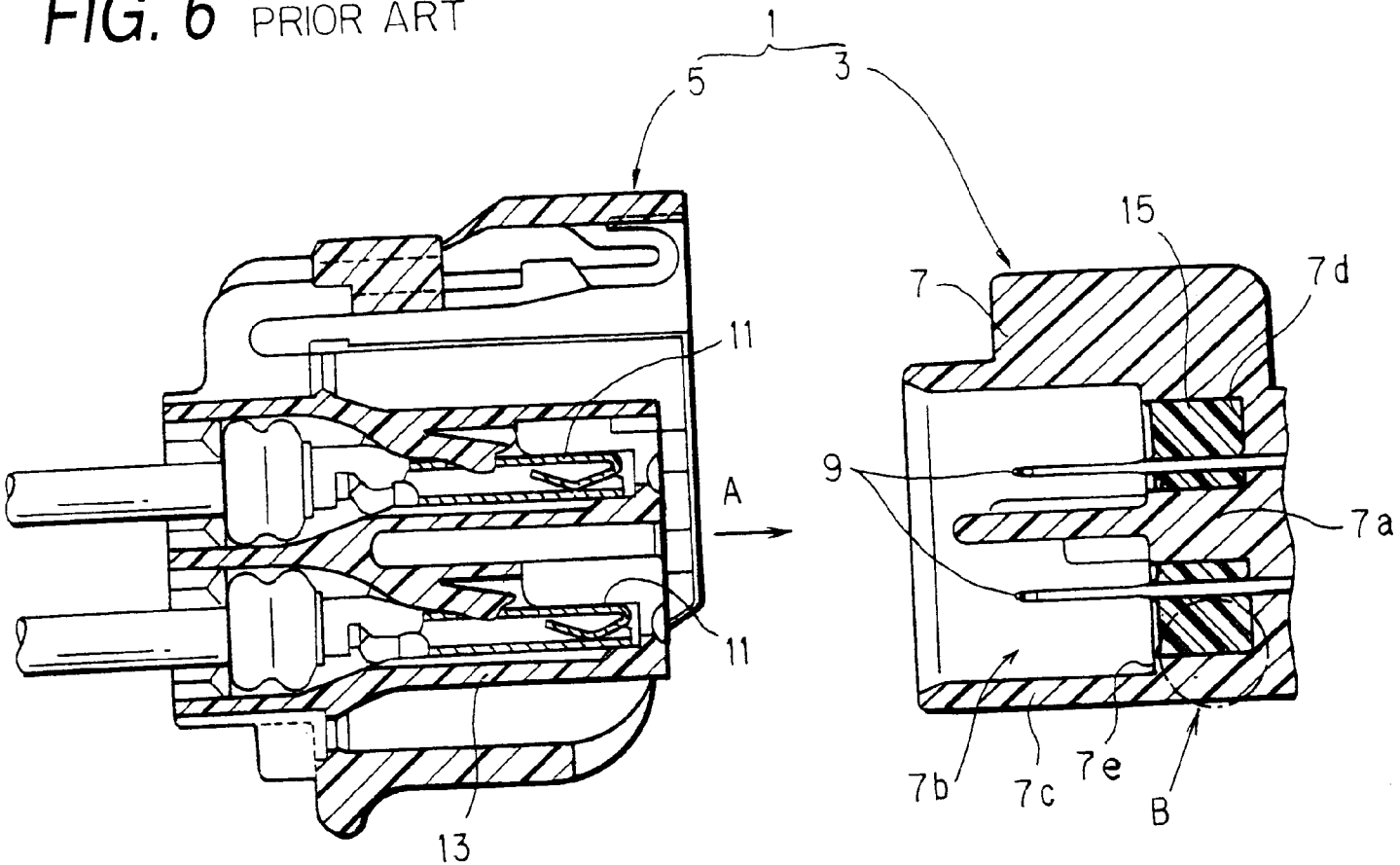
FIG. 6 PRIOR ART
FIG. 6 is a vertical cross-sectional view showing important portions of the liquid-tight connector of FIG. 5.
Figure 7:
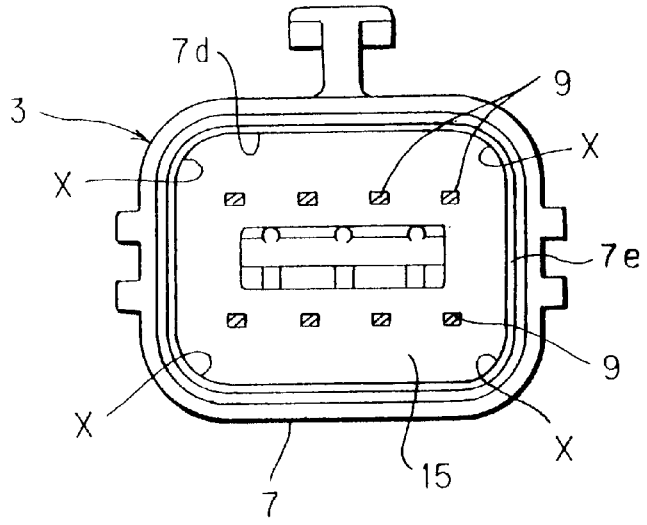
FIG. 7 PRIOR ART
FIG. 7 is a view as seen in a direction of arrow A of FIG. 6.
Figure 8:
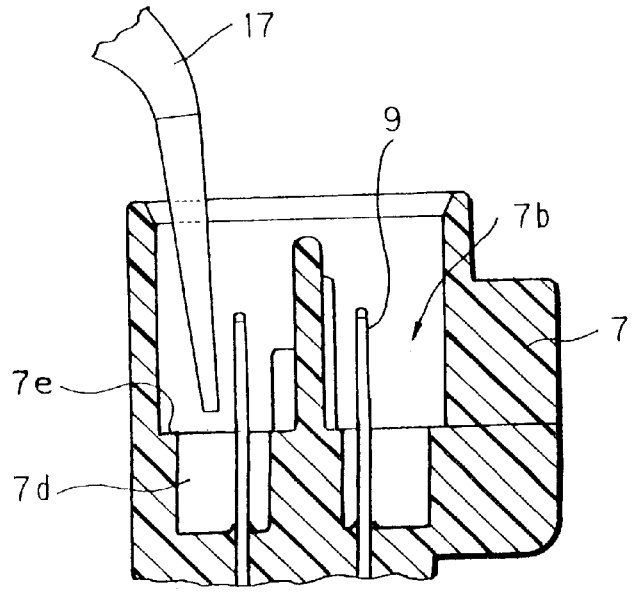
FIG. 8 PRIOR ART
FIG. 8 is a view showing a method of pouring a filling material into a housing of FIG. 6.
Figure 9:
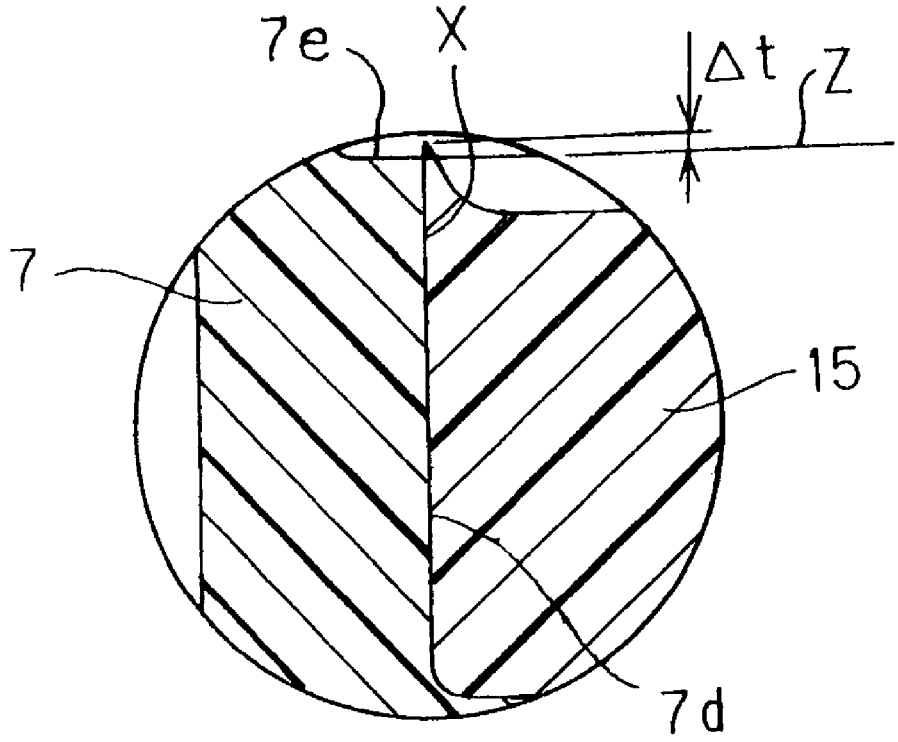
FIG. 9 PRIOR ART
FIG. 9 is an enlarged view of a portion B of FIG. 6, showing a rise of a liquid level of the filling material at a corner portion of a filling material-pouring recess.

As shown in FIGS. 1 and 2, the liquid-tight connector 20 of this embodiment comprises a housing 23 of a synthetic resin for mounting on a transmission casing (not shown) of an automobile, and a connector 5 of a synthetic resin having a male connector portion 13 for fitting in a female connector portion 25 of the housing 23. The liquid-tight connector 20 of this embodiment has the same construction as that of the conventional liquid-tight connector 1 of FIGS. 5 and 6 except the connector portion 25.

The female connector portion 25 of the housing 23 includes an inner bottom wall 25*a* through which male metal terminals 9 extends, and a fitting peripheral wall 25*c* which forms a engaging recess portion 25*b* fitted with the male connector portion of the mating connector by extending from a peripheral edge portion of the inner bottom wall 25*a* in a direction of projecting of the metal terminals 9.

The other end portions (right end portions in FIG. 1) of the metal terminals 9 provided in the housing 23 extend through the inner bottom wall 25*a* of the female connector portion 25 into the interior of the transmission casing, and are electrically connected respectively to connection terminals of electrical parts within the transmission casing.

In order to enhance the sealing performance of the metal terminal-passing portions (through which.the metal terminals 9 pass) of the housing 23, the metal terminals 9 are insert molded in the connector body 25 to be integrally connected thereto, and the filling material-pouring recess 25*d* is formed in that side (surface) of the inner bottom wall 25*a*, facing the fitting recess portion 25*b*, to receive those portions of the metal terminals 9 projecting from the inner bottom wall 25*a* into the fitting recess portion 25*b*. A suitable amount of the filling material 15, such as an epoxy resin, is poured into the filling material-pouring recess 25*d*, thereby perfectly sealing the metal terminal-passing portions.

The filling material-pouring recess 25*d* has a generally rectangular transverse cross-section including a bottom base portion 25*f*, and three steps 31, 32 and 33 are formed on a peripheral surface of the filling material-pouring recess 25*d* over the entire periphery thereof to form a stair-like portion spreading outwardly toward an open end of the pouring recess 25*d*.

As shown in FIG. 3, the filling material 15 is poured into the filling material-pouring recess 25*d* in the housing 23 by the use of a nozzle 17 insertable into the fitting recess portion 25*b*. The fitting recess portion 25*b* in the housing 23 has a narrow open end, and therefore the nozzle 17 is inserted generally vertically into the fitting recess portion 25*b* as shown in FIG. 3. Then the filling material 15 is poured.

During the pouring of the filling material 15 by the nozzle 17, the filling amount is confirmed through the open end of the fitting recess portion 25*b* with the eyes. When the liquid level of the poured filling material 15 rises beyond the uppermost step 33 in the filling material-pouring recess 25*d*, the pouring of the filling material is stopped.

During the pouring of the filling material 15 into the housing 23, the liquid level of the poured filling material 15 rises, so that the three steps are sequentially submerged in the poured filling material 15 in the order from the lower one, as shown in FIGS. 4(*a*) to 4(*c*). Therefore, the displacement of the liquid level clearly differs visually, depending on whether or not the liquid level rises beyond the step 31, 32, 33, and therefore this displacement can be easily confirmed with the eyes.

Therefore, the uppermost step 33 is spaced downwardly a suitable distance from the boundary between the fitting recess portion 25*b* and the filling material-pouring recess 25*d* so that the amount of filling of the filling material 15 can become proper when the liquid level reaches the uppermost step 33. With this arrangement, there can be avoided disadvantages that the filling amount is so small that the sufficient sealing performance can not be achieved and that the filling amount is so large that the filling material 15 overflows into the fitting recess portion 25*b*.

A surface tension of the filling material 15 is higher at each corner portion X of the filling material-pouring recess 25*d* than at the other portions thereof, and therefore the liquid level becomes higher at the corner portions X than at the other portions. Therefore, the liquid level of the filling material 15 rises beyond the steps 31, 32 and 33 at the corner portions X earlier than at the other portions. However, at this time, the liquid surface of the filling material spreads, and the liquid level-raising force is consumed in enlarging the area of the liquid surface. As a result, the rise of the liquid level at the corner portions X of the filling material-pouring recess 25*d* can be suppressed.

Therefore, there can be prevented the incomplete fitting connection between the two connectors due to the solidification of the filling material 15 overflowed into the fitting recess portion 25*b* to be deposited on the inner surface (e.g. a bottom surface 25*e*) of the fitting recess portion 25*b*. Particularly, there can be positively prevented a disadvantage that part of the filling material 15 is deposited on the bottom surface 25*e* of the fitting recess portion 25*b* because of the rise of the liquid level at the corner portions X of the filling material-pouring recess 25*d*, and is solidified, thus inviting the incomplete fitting connection between the two connectors.

In the above embodiment, although the steps 31, 32 and 33 are formed continuously on the peripheral surface of the filling material-pouring recess 25*d* over the entire periphery thereof, the steps of the present invention are not limited to such configuration, but can take various forms. For example, the steps do not always need to be formed continuously on the, peripheral surface of the filling material-pouring recess over the entire periphery thereof in so far as the liquid level of the filling material 15 in the filling material-pouring recess 25*d* can be confirmed over the entire periphery thereof. In this case, however, consideration must be given so that the liquid level or surface of the poured filling material will not become uneven or irregular.

In the above embodiment, although the three steps 31, 32 and 33 are formed on the peripheral surface of the filling material-pouring recess 25*d*, the number of these steps are not limited to three, but can be set to a suitable number such as one and two or more.

Although the above embodiment is directed to the liquid-tight connector for mounting on the transmission casing of the automobile, the present invention is not limited to such a liquid-tight connector, but can be applied to a liquid-tight connector for other use in so far as this liquid-tight connector has a filling material-pouring recess similar to that of the above embodiment.

In the above-mentioned liquid-tight connector of the present invention, when the filling material is poured into the filling material-pouring recess provided at the inner end of the fitting recess portion of the female connector portion, through the open end of the fitting recess portion, by the nozzle, the displacement of the liquid level of the filling material during this pouring operation clearly differs visually, depending on whether or not the liquid level rises beyond the step portion, and therefore this displacement can be easily confirmed with the eyes.

Therefore, the uppermost step is spaced downwardly a suitable distance from the boundary between the fitting recess portion and the filling material-pouring recess so that the amount of filling of the filling material can become proper when the liquid level reaches the uppermost step. With this arrangement, there can be avoided disadvantages that the filling amount is so small that the sufficient sealing performance can not be achieved and that the filling amount is so large that the filling material overflows into the fitting recess portion.

In the case where the filling material-pouring recess has a generally rectangular transverse cross-section, a surface tension of the poured filling material is higher at each corner portion of the filling material-pouring recess than at the other portions thereof, and therefore the liquid level of the filling material rises beyond the steps at the corner portions earlier than at the other portions. However, at this time, the liquid surface of the filling material spreads, and the liquid level-raising force is consumed in enlarging the area of the liquid surface. As a result, the rise of the liquid level at the corner portions of the filling material-pouring recess can be suppressed.

Therefore,-there can be provided the satisfactory liquid-tight connector in which there can be positively prevented the incomplete fitting connection between the two connectors due to the solidification of the filling material overflowed into the fitting recess portion to be deposited on the inner surface (e.g. the bottom surface) of the fitting recess portion.

What is claimed is:

1. A liquid-tight connector comprising:

a female connector housing having a fitting recess portion mateable with a male connector housing, said female connector housing including a bottom wall through which metal terminals project and said bottom wall has a filling material-pouring recess therein around base portions of said metal terminals; and a filling material provided in said filling material-pouring recess wherein said female connector housing has a step portion, spreading outwardly toward an open end of said filling material-pouring recess, formed at least partially on a peripheral surface defining said filling material-pouring recess, wherein said filling material is introduced through said open end.

2. A liquid-tight connector according to claim 1, wherein said step portion includes at least one step.

3. A liquid-tight connector according to claim 1, wherein said step portion is formed entirely on said peripheral surface of said filling material-pouring recess.

4. A liquid-tight connector according to claim 3, wherein said step portion includes at least one step.

5. A liquid-tight connector comprising:

a female connector housing including:

a fitting recess portion mateable with a male connector housing, said fitting recess portion including an open end and a bottom surface substantially perpendicular to an insertion direction of said male connector housing said bottom surface being connectable with an end of said male connector housing;

a base portion from which metal terminals project, said base portion being locate opposite from said open end with respect to said bottom surface;

a step portion located between said base portion and said bottom surface, said step portion spreading outwardly toward said open end and defining a filling material-pouring recess into which a filling material is injected through said open end to seal said metal terminals.

6. A liquid-tight connector according to claim 5, wherein said step portion includes at least one step.

7. A housing of a liquid-tight female connector adapted to mate with a male connector including a male connector portion, said male connector portion defining a first sectional area, said housing comprising:

a fitting recess portion for receiving said male connector portion, said fitting recess portion having an open end, a bottom surface opposite from said open end, and a first peripheral wall connecting said open end to said bottom surface;

said first peripheral wall defining a second sectional area at least as large as said first sectional area;

a base portion located opposite from said first peripheral wall with respect to said bottom surface;

a second peripheral wall adjacent to said bottom surface, and located between said bottom surface and said base portion;

said second peripheral wall defining a third sectional area smaller than said second sectional area;

a first step adjacent to said second peripheral wall and located between said second peripheral wall and said base portion, said first step defining a fourth sectional area smaller than said third sectional area, wherein at least one of said third and fourth sectional areas is filled with a filling material.

8. A housing of a liquid-tight female connector according to claim 7:

a second step adjacent to said first step and located between said first step and said base portion, said second step defining a fifth sectional area smaller than said fourth sectional area.

9. A housing of a liquid-tight female connector according to claim 8:

a third step adjacent to said second step and located between said second step and said base portion, said third step defining a sixth sectional area smaller than said fifth sectional area.

* * * * *